United States Patent [19]

Berkman

[11] 4,219,062

[45] Aug. 26, 1980

[54] MAGNETIC FASTENER-HOLDING TOOL ATTACHMENT

[75] Inventor: Samuel Berkman, Florham Park, N.J.

[73] Assignee: BST & Associates, Inc., Florham Park, N.J.

[21] Appl. No.: 50,774

[22] Filed: Jun. 21, 1979

[51] Int. Cl.[3] ..... B25B 15/00

[52] U.S. Cl. ..... 145/52; 145/50 DA

[58] Field of Search ..... 145/50 DA, 50 D, 52, 145/30 A, 30 R

[56] References Cited

U.S. PATENT DOCUMENTS

| | | | |
|---|---|---|---|
| 2,491,860 | 12/1949 | Ingraham | 145/46 |
| 2,688,991 | 9/1954 | Doyle | 145/52 |
| 2,960,131 | 11/1960 | Clark | 145/52 |
| 3,731,722 | 5/1973 | Carr | 145/50 DA |

FOREIGN PATENT DOCUMENTS

| | | | |
|---|---|---|---|
| 635672 | 3/1962 | Italy | 145/52 |

*Primary Examiner*—Nicholas P. Godici
*Assistant Examiner*—J. T. Zatarga

[57] ABSTRACT

A tool attachment for holding a fastener to a driver therefor comprises a magnetic holding assembly to which are attached spring fingers for grasping a fastener. The construction of the magnetic holding assembly provides for attachment of the device to elongated shafts of various shapes and sizes. The magnetic holding assembly is particularly characterized by an elongated, centrally-disposed pole piece which extends in the same direction as the axis of rotation of the shaft of the driver tool, when the attachment is in place. Magnets are attached to opposite sides of the pole piece in like-pole to like-pole relation, and the holding force so provided is quite high.

8 Claims, 6 Drawing Figures

MAGNETIC FASTENER-HOLDING TOOL ATTACHMENT

BACKGROUND OF THE INVENTION

This invention relates to an attachment for holding a fastener to a driver therefor.

In the use of rotatable fasteners, such as screws, bolts and the like, conditions often occur that make it difficult for an artisan to hold the fastener manually while starting the fastener into the work. The present attachment is adapted to hold a fastener, under such conditions, in engaged relation with a driver therefor, so as to relieve the artisan from the need to hold the fastener manually and thus enable one-handed operation.

This application is related, as an improvement application, to my copending application Ser. No. 809,163, filed June 23, 1977, and entitled TOOL FOR HOLDING A FASTENER TO A DRIVER THEREFOR. The disclosure of that copending application is hereby incorporated by reference.

As was discussed in my copending application, tools are known which are provided with fastener holding means. Fastener holding devices designed as separate attachments to conventional drivers are also known. The magnetic holding attachment of my copending application is adapted to be used in association with a wide variety of driver tools. The magnetic attachment feature permits use of the tool with drivers having ferrous metal portions of various cross-sectional sizes and shapes. My earlier device is particularly characterized by a magnetic block assembly which has either a V-grooved side, for engaging cylindrical shafts, or end pole pieces which are themselves provided with V-grooves for this purpose.

The present application describes a structure which provides improved magnetic holding power, as compared with my earlier device, and which is particularly adapted to resist dislodging once it is in place. Moreover, the present device retains all of the advantages of my earlier device.

Also described in this application is a combination of my new magnetic fastener-holding attachment tool with a driver tool. In this example, the driver tool is provided with an elongated groove extending in the direction of the axis of rotation of the driver. The groove has a shape and size arranged to receive a center pole piece of the holding assembly of the attachment, in relatively close-fit relation. In this combination, the resistance of the attachment tool to removal or dislodgement owing to forces applied to the side of the attachment tool, which are often encountered in actual use, is substantially increased.

DETAILED DESCRIPTION OF THE INVENTION

Figure 1:
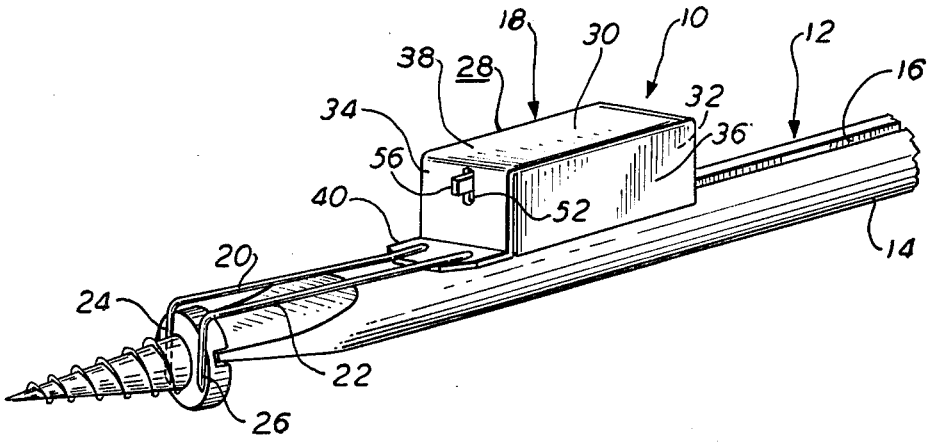
FIG. 1 is a partial perspective view of one embodiment of my new magnetic fastener-holding attachment in its position on a driver tool which has an elongated, pole piece receiving groove.
Figure 2:
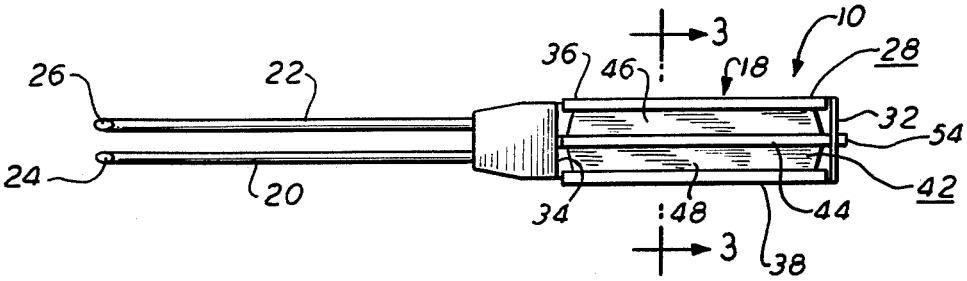
FIG. 2 is a bottom plan view of the attachment shown in FIG. 1.
Figure 3:
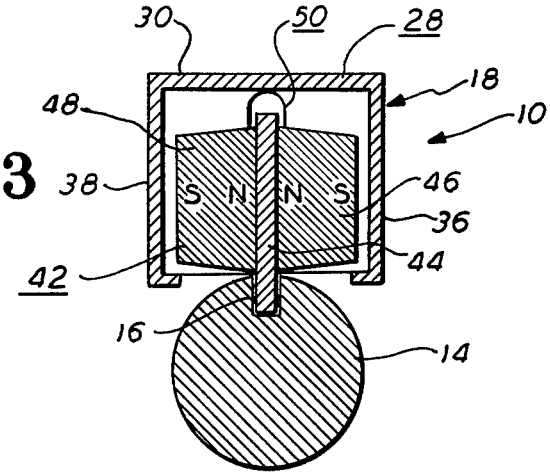
FIG. 3 is an enlarged cross-sectional view taken on the line 3—3 of FIG. 2.

In one of its embodiments, the present fastener-holding attachment is indicated at 10 in FIGS. 1 to 3. As there shown, the attachment 10 is in engaged relation with a screwdriver 12 which has an elongated shaft 14 of circular cylindrical shape. In this embodiment, the shaft 14 is provided with an elongated groove 16 extending in the direction of the axis of rotation of the shaft 14. The purpose of the groove 16 is to aid in the resistance of the attachment 10 to removal owing to forces applied laterally thereto in a manner which will be described completely hereinafter. In this aspect, I intend that the attachment 10 and the screwdriver 12 be available for sale as a combination. It will be understood that the attachment 10 can be used with driving tools which are not provided with a groove like the groove 16 so that the attachment 10 can be sold alone.

In the embodiment of FIGS. 1 to 3, the attachment 10 comprises a magnetic holding assembly 18. Extending from the holding assembly 18 are a pair of cylindrical spring rods 20 and 22 which are attached to the assembly 18 in any desired manner. Each of the rods 20 and 22 is L-shaped with a long portion of each extending out from the assembly 18 in a direction such that these portions of the rods 20 and 22 will lie substantially parallel to the axis of rotation of the shaft 14 of the screwdriver 12, in this example. Relatively short portions 24 and 26 of the rods 20 and 22, respectively, lie at substantially right angles to the longer portions thereof and thus extend in a direction substantially normal to the axis of rotation of the shaft 14. This relationship is the same as that in the fastener holding attachment described in my earlier application referred to above.

The magnetic holding assembly 18 in the present embodiment has a sheet metal case 28 of nonmagnetic material, such as brass or bronze. The case 28 has a top wall 30, end walls 32 and 34, and side walls 36 and 38. One of the end walls, in this case the end wall 32, is provided with a tab 40 extending substantially at a right angle thereto. This tab 40 provides a shelf on which the rods 20 and 22 may be attached. The attachment of the rods 20 and 22 to the tab 40 may take any desired form, such as cold welding or soldering.

Disposed within the case 28 is a magnet means 42 (FIGS. 2 and 3). The magnet means 42 has a ferrous pole piece 44, adapted to lie centrally within the case 28, parallel to the side walls 36 and 38 thereof. On the opposite sides of the pole piece 44 are magnets 46 and 48, attached to the pole piece 44 by means of an adhesive, for example. An adhesive is necessary because the magnets 46 and 48 are disposed in like-pole to like-pole repelling, relation. This relation maximizes the amount of flux available to be carried by the pole piece 44 and thereby maximizes the holding force of the assembly. The magnet means 42 is disposed in the case 28 in relatively loose and movable relation. This is for the purpose of accommodating the attachment 10 to use with driver tools having different shapes and sizes. In particular, the movement which is required is movement radially with respect to the shaft of the driver tool when the attachment 10 is applied to the driver tool. It is desirable, though not necessary, to employ some means for guiding the magnet means 42 for motion in this direction. In the embodiment of FIGS. 1 to 3, this guiding means comprises a pair of slots 50 and 52, one each in the end walls 32 and 34 of the case 28. The pole piece 44 has projection ears 54 and 56 which extend through these slots 50 and 52 in slidable relation thereto.

In the usual manner of using the attachment 10, the rods 20 and 22 are manually spread so that the portions 24 and 26 thereof which lie normal to the axis of the driver tool can span the shank of a fastener to be driven, after which they are released into engagement with the fastener. The magnetic holding assembly 18 is then engaged with the shaft of the driver tool and moved along the shaft to bring the fastener into engagement with the driver. If the driver tool has a slot or groove like the groove 16, the pole piece 44 is inserted into that groove. In this way, the attachment is resistant to torques about a normal to the top surface 30 of the case 28, as well as to lateral displacement resulting from forces which may be applied to the side surfaces 36 and 38 of the case 28. Such forces are often encountered in actual use.

Once the attachment 10 is properly mounted on the driver tool, the fastener to be driven may be started into the work. After the fastener has been well started, the attachment 10 can be quickly and easily removed from the side of the driver without disengaging the driver from the fastener, so that the driving of the fastener can be completed.

Figure 4:
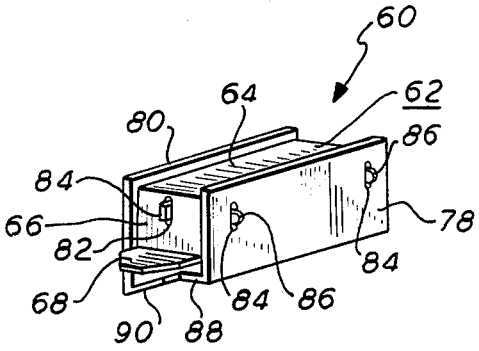
FIG. 4 is a partial perspective view of another embodiment of a magnetic holding assembly useful in the present tool attachment.
Figure 5:
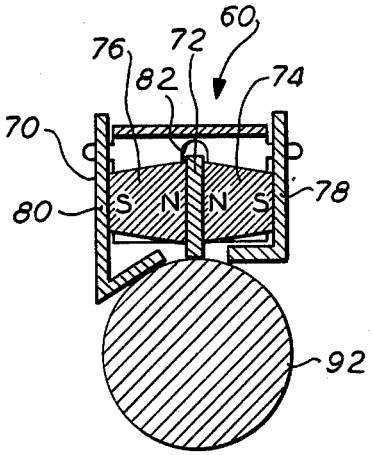
FIG. 5 is an enlarged cross-sectional view of the magnetic holding assembly of FIG. 4 taken on the line 5—5 of FIG. 4, shown in place on a shaft of circular cross section.
Figure 6:
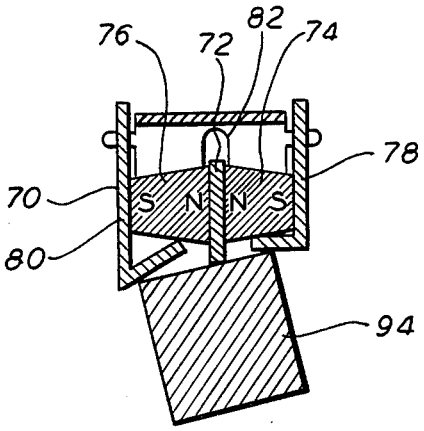
FIG. 6 is an enlarged cross-sectional view showing the embodiment illustrated in FIG. 4 in engaged relation with a shaft having a square cross section.

FIGS. 4, 5, and 6 illustrate another embodiment of a magnetic holding assembly, designated here by the reference numeral 60, which can be used in the fastener holding attachment 10. The fastener holding spring fingers have been omitted for clarity of illustration. The magnetic holding assembly 60 in this embodiment provides holding power superior to that of the construction shown in FIG. 1.

The magnetic holding assembly 60 has a case 62, of nonmagnetic material such as brass or bronze which, in this embodiment, has open sides. The case 62 has a top wall 64 and end walls, one of which, 66, appears in FIG. 4. The end wall 66 carries a tab 68 like the tab 40 of the assembly 18.

Disposed within the case 62 is a magnet means 70 like the means 42 of the attachment 10 and in this case comprising a center pole piece 72, two magnets 74 and 76 attached to the pole piece 72 in like-pole to like-pole relation, and two outside pole pieces 78 and 80. As in the attachment 10 the magnet means 70 is movable relative to the case 62. In addition, the outside pole pieces 78 and 80 are each movable with respect to the center pole piece 72 and the magnets 74 and 76.

Guiding means are provided in this embodiment also and in this case the guiding means comprises a pair of slots, one of which is seen at 82, one each in the end walls 66 of the case 62. The center pole piece 72 has projecting ears, one of which is seen at 84, which extend through the slots 82 in slidable relation thereto. Guide means for the outside pole pieces 78 and 80 is also provided. In my preferred embodiment, there are slots 84 in each of the outside pole pieces 78 and 80. Portions of the end walls 66 of the case 62 project as ears through the slots 84.

The outside pole pieces 78 and 80 are preferably not symmetrical. In the present embodiment of the assembly 60, the outside pole piece 78 has an inturned flange 88 extending substantially at right angles to the major plane of the pole piece 78 toward the center pole piece 72. The other outside pole piece 80 is slightly longer, in the vertical direction, than the pole piece 78 and has an inturned flange 90 which extends at an acute angle to the major plane of the outside pole piece 80. In this way, the two flanges 88 and 90 corporate to define a V-groove to aid in aligning the assembly 60 with a cylindrical shaft. Owing to the fact that both outside pole pieces 78 and 80 do not have the acute angle flanges, the assembly 60 is more readily adapted to contact flat surfaces as well.

FIGS. 5 and 6 are provided to illustrate the structure of the assembly 60 further and to show the relationship of the parts when the assembly 60 is attached to a cylindrical (FIG. 5) and a square (FIG. 6) tool shaft. As shown in FIG. 5, the assembly 60 contacts the cylindrical shaft 92 along three lines of contact. One line of contact is at the center pole piece 72. Another line of contact is at the inside lower corner of the flange 88 of the outside pole piece 78, and the third line of contact is somewhere along the surface of the flange 90 of the outside pole piece 80. This arrangement couples more flux into the shaft 92 than is coupled into the shaft 14 by the assembly 18. Owing to the movement capabilities of the three pole pieces relative to each other the apparatus can adjust itself readily to accommodate shafts of various radii.

FIG. 6, as pointed out above, shows the assembly 60 in engaged relation with a shaft 94 of square cross-section. In this case, the assembly 60 will tilt over slightly to the right as seen in FIG. 6, but, again, three lines of contact between the assembly 60 and the shaft 94 are evident. The reason for the non-symmetrical relation of the outside pole pieces should now be apparent. By omitting the acute angle on one of the pole pieces, an effective V-groove of relatively large angle is provided. This then allows the relative movement between the various pole pieces to be relatively small.

What is claimed is:

1. A magnetic fastener-holding tool attachment adapted to hold a rotatable fastener in engaged relation with a driver therefor comprising a magnetic holding assembly including at least two magnets, means for holding said two magnets in like-pole to like-pole relation, at least one elongated pole piece positioned between said two magnets and having an elongated surface for engaging the surface of a driver tool along a direction generally parallel to the axis of rotation of the driver tool, and a pair of resilient rods extending from said magnetic holding assembly, said rods each having a first portion adapted to extend in a direction generally parallel to said axis of rotation and a second portion adapted to extend in a direction generally transverse to said axis of rotation.

2. A tool attachment as defined in claim 1, wherein said attachment further comprises a sheet metal case around said magnets.

3. A tool attachment as defined in claim 2, wherein said case is of nonmagnetic material.

4. A tool attachment as defined in claim 3, wherein said magnets and said pole piece are movable within said case, and said attachment further comprises means for guiding said magnets and said pole piece for motion toward and away from the driver.

5. A tool attachment as defined in claim 4, wherein said case has open sides, said tool attachment further comprising two outside pole pieces, one each disposed adjacent the ends of said magnets remote from the first-mentioned pole piece, said outside pole pieces lying generally in planes parallel to the plane of the first-mentioned pole piece.

6. A tool attachment as defined in claim 5, wherein said outside pole pieces are asymmetrical, one of said outside pole pieces having an inturned flange extending, substantially at right angles to the general plane thereof, toward said center pole piece, the other of said outside pole pieces having an inturned flange extending towards said center pole piece at an acute angle to the general plane of said other outside pole piece.

7. A tool attachment as defined in claim 5, further comprising means for guiding said magnets and said pole pieces for movement relative to each other toward and away from the driver.

8. A tool attachment as defined in claim 7, wherein said guiding means comprises ears extending laterally outwardly from the end walls of said case, and slots in said outside pole pieces adapted to slidably receive said ears.

* * * * *